US005338229A

United States Patent [19]

Egenolf

[11] Patent Number: 5,338,229

[45] Date of Patent: Aug. 16, 1994

[54] ELECTRICAL CONTACT

[75] Inventor: Bernhard Egenolf, Dreieich-Sprendlingen, Fed. Rep. of Germany

[73] Assignee: The Whitaker Corporation, Wilmington, Del.

[21] Appl. No.: 145,042

[22] Filed: Oct. 26, 1993

Related U.S. Application Data

[63] Continuation of Ser. No. 888,236, May 22, 1992, abandoned.

[30] Foreign Application Priority Data

Jun. 3, 1991 [DE] Fed. Rep. of Germany ..... 9106776
Mar. 31, 1992 [GB] United Kingdom ..... 9206962.4

[51] Int. Cl.[5] ..... H01R 13/18
[52] U.S. Cl. ..... 439/839
[58] Field of Search ..... 439/744, 745, 839, 847, 439/891

[56] References Cited

U.S. PATENT DOCUMENTS 4,534,610 8/1985 Takihara ..... 439/839
4,540,235 9/1985 Lolic ..... 439/839
4,699,444 10/1987 Isohata ..... 439/839
4,834,681 5/1989 Chaillot ..... 439/856

FOREIGN PATENT DOCUMENTS 0108878 5/1984 European Pat. Off. .
0196367A1 4/1985 European Pat. Off. .
0189821 8/1986 European Pat. Off. .
3248078 6/1984 Fed. Rep. of Germany .

OTHER PUBLICATIONS

English Translation of French Patent Application 2,627,020.

*Primary Examiner*—Gary F. Paumen
*Attorney, Agent, or Firm*—Eric J. Groen; Timothy J. Aberk

[57] ABSTRACT

An electrical contact (11) adapted for plugging connection, comprising a pair of contact spring arms (25) for pluggably receiving a tab contact. The contact (11) has arranged on its outside an outer back-up spring (13) including a pair of outer back-up spring arms cooperating with the contact spring arms (25). The outer back-up spring (13) can be slid onto the outside of the contact (11) from a matingside end of the contact spring arms (25) and is adapted to be snapped onto said contact (11).

12 Claims, 8 Drawing Sheets

ELECTRICAL CONTACT

This application is a continuation of application Ser. No. 07/888,236 filed May 22, 1992, now abandoned.

BACKGROUND OF THE INVENTION

1. Field of the Invention

The invention relates to an electrical contact, comprising at least one pair of contact spring arms and having arranged on its outside an outer back-up spring including at least one pair of outer back-up spring arms cooperating with the contact spring arms.

2. Description of the Prior Art

A contact of this type is known from German Patent Specification 32 48 078. This contact comprises a box-shaped contact body, and the outer back-up spring also has a box-shaped outer back-up spring body fitting onto the contact body. Locking of the outer back-up spring on the contact is effected in that, after sliding of the outer back-up spring onto the contact, predetermined portions of the outer back-up spring body are bent into recesses and behind transverse edges of the contact body, respectively. It is also known to bend locking lances projecting from the outer back-up spring about corresponding sidewalls of the contact and to clamp them there after placement of the outer back-up spring onto the contact.

Such methods of attaching the outer back-up spring on the contact have the disadvantage that the locking bending operation of certain portions of the outer back-up spring must be performed on a relatively complex structure, namely on the assembly of contact and outer back-up spring. This requires complicated machines.

SUMMARY OF THE INVENTION

It is the object of the invention to reduce the assembling expenditure necessary for locking the outer back-up spring on the contact.

This object is met in that, with the contact indicated at the outset, the outer back-up spring can be slid onto the outside of the contact from a mating side end of the contact spring arms and is adapted to be snapped onto said contact.

This is preferably achieved in that the contact is provided with transverse edges at suitable locations and that locking projections or locking lances project from the outer back-up spring into the interior thereof and lockingly cooperate with wire-terminating-side and mating-side transverse edges of the contact, with the or each locking lance on the wire terminating side of the outer back-up spring being resiliently deflectable such that it can slidingly pass the wall portion of the contact located between mating-side transverse edge and wire-terminating-side transverse edge, until it is snappingly locked behind the wire-terminating-side transverse edge of the contact. The locking projection on the mating side preferably is provided in the form of a stop cooperating with the mating-side transverse edge of the contact.

When the locking projection on the wire terminating side is formed by pushing a corresponding portion of the outer back-up spring inwardly in non-shearing manner, the outer back-up spring is to be designed such that its associated wall portion has the necessary resilience.

Forming of the transverse edges and locking lances on the contact and the outer back-up spring, respectively, can be carried out with the solution according to the invention prior to applying the outer back-up spring on the contact. These operations are performed preferably before the contact and the outer back-up spring are formed from the respective stamped blanks. At this early manufacturing stage, the formation of the transverse edges and locking lances still is possible with relatively simple tools.

Further developments of the contact according to the invention are indicated in the dependent claims.

DETAILED DESCRIPTION OF THE PREFERRED EMBODIMENT

Figure 1:
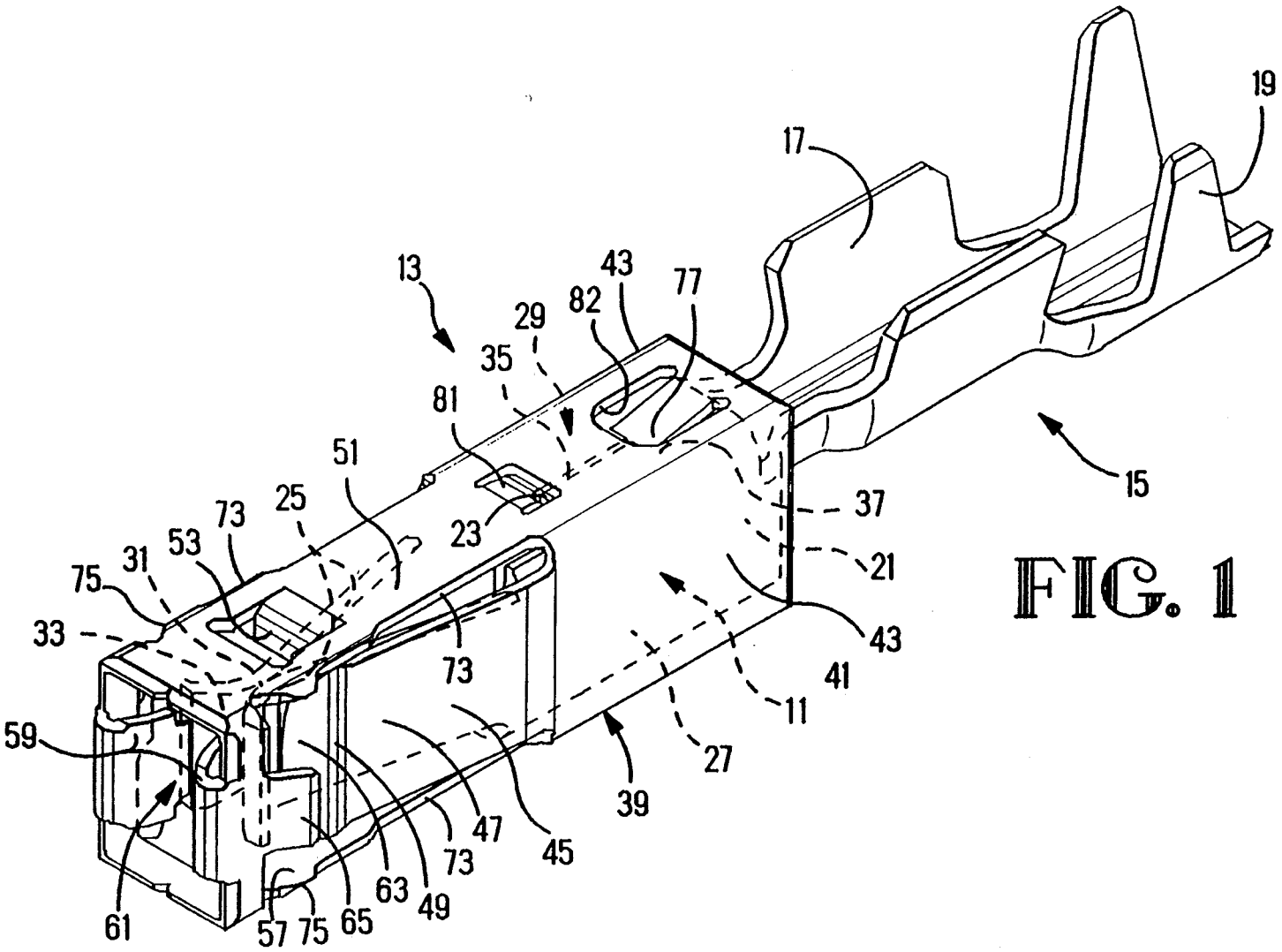
FIG. 1 shows a perspective side view of a contact according to the invention.

FIG. 1 shows a contact 11 adapted for plugging connection, which is constructed in the form of a receptacle contact and is provided with an outer back-up spring 13. Those portions of contact 11 that are hidden by the outer back-up spring 13 are shown in broken lines.

Contact 11 comprises a wire terminating portion 15 having in known manner a conductor crimping zone 17 and an insulating crimping zone 19. Conductor crimping zone 17 is crimped onto a stripped electrical conductor of an electrical wire. Insulation crimping zone 19 is crimped onto the remaining insulating jacket of the wire.

Contact 11 comprises a contact body 21 following said wire terminating portion 15 and, in the embodiment shown, being provided in the form of a closed box of substantially rectangular cross-section. A pair of contact spring arms 25 projects from the mating-side longitudinal end 23 of contact body 21. Each of the two contact spring arms 25 constitutes an integral continuation of one of two opposing sidewalls 27, 29 of the contact body 21.

The contact 11 shown in the figures is a single flat spring contact. However, it could also be provided in the form of a double flat spring contact, in which two contact arms each would project from each of the two sidewalls 27, 29 of contact body 21.

The two contact spring arms 25 extend towards each other in converging manner until they contact each other in a line of contact 31. On the side of the contact line 31 located on the mating side, the free ends of contact spring arms 25 diverge so as to form an insertion funnel 33. The insertion funnel 33 facilitates insertion of a flat contact, which often is also referred to as tab contact.

Due to the fact that contact 11 is stamped and formed from one single piece of sheet metal, the box-shaped contact body 21 thereof has an abutment seam 35 extending in the longitudinal direction thereof. In the embodiment shown in FIG. 1, the abutment seam is located in the, with respect to FIG. 1, upper wall of contact body 21, which will be referred to as top part 37 hereinafter.

The outer back-up spring 13 comprises an outer back-up spring body 39. The outer back-up spring 13 extends from the wire-terminating-side end of contact body 21 beyond the free ends of the insertion funnel 33 of the contact spring arms 25. Outer back-up spring body 39 comprises a box-portion 41 of substantially rectangular, closed box-shape, which is seated on the contact body 21 and encloses the same. One outer back-up spring arm 45 each is cut free from opposing sidewalls 43 of the outer back-up spring body 39. The two outer back-up spring arms 45 coming from box portion 41 converge at a first angle of convergence. Starting from a bending line 47 in the vicinity of the free ends 49 thereof, the two outer back-up spring arms 45 converge at a greater angle of convergence.

From top part 51 of the outer back-up spring body 39, which is shown on top in FIG. 1, a spacing lug 53 is cut free and is bent with its free end into the interior of the outer back-up spring body 39 at right angles with respect to top part 51. As can be seen best from FIGS. 3 and 4, the outer back-up spring arms 45, in the longitudinal direction of the bent portion of said spacing lug 53, are of greater width than the contact spring arms 25, such that the outer back-up spring arms 45 in terms of width project on both sides in the form of extensions 55 beyond the longitudinal edges of the contact spring arms 25. The depth of the portion of the spacing lug 53 projecting between the outer back-up spring arms 45 is selected such that the spacing lug 53 does not extend downwardly as far as to reach the contact spring arms 25.

Figure 3:
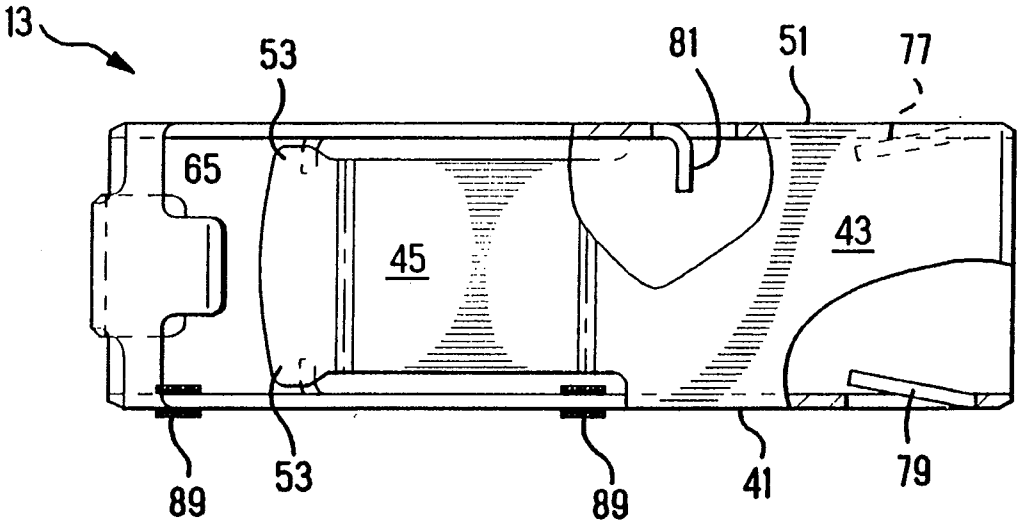
FIG. 3 shows a side plan view of the back-up spring.

As can be seen best from FIG. 3, a spacing lug 53 does not only extend from the top part 51 of the outer back-up spring body 39, but a spacing lug 53 extends also from the bottom part 57 thereof between the lower projecting extensions 55 of the two outer back-up spring arms 45.

The spacing lugs 53 are positioned in the longitudinal direction of extension of the outer back-up spring 13 such that they come to lie between the outer back-up spring arms 45 in the region of bending line 47.

Figure 2:
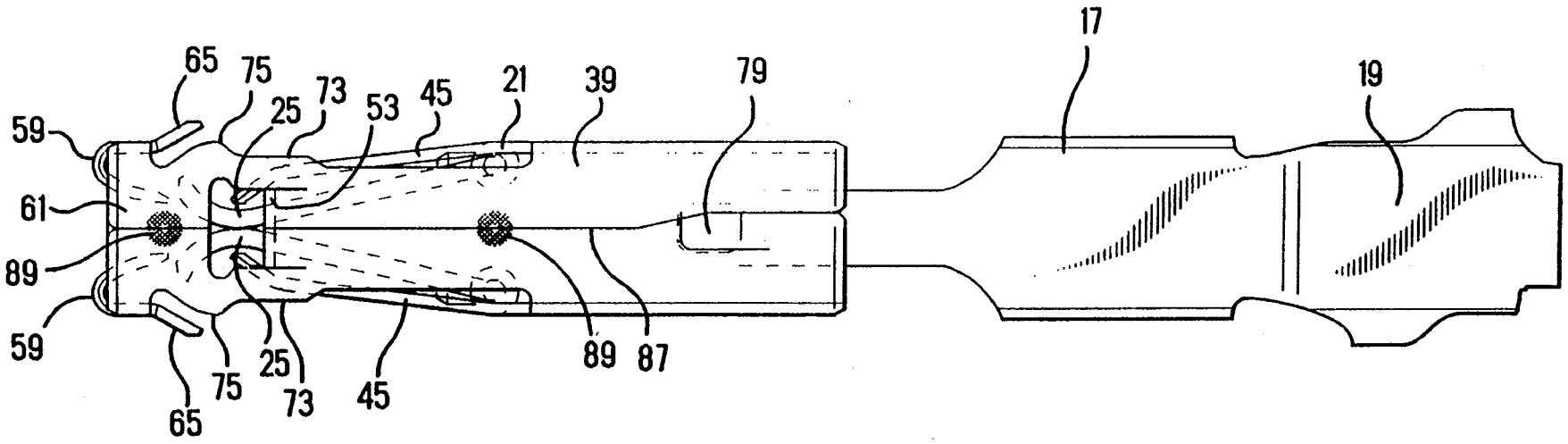
FIG. 2 shows a bottom plan view of a contact substantially identical with that of FIG. 1.

As can be seen best in FIGS. 2 and 3, the free ends of the outer back-up spring arms 45 are located substantially at the level of the contact line 31 of the contact spring arms 25, but are held spaced from the contact spring arms 25 by said spacing lugs 53.

When a tab contact (not shown in the drawings) is inserted between the opposing contact spring arms 25, this causes the two contact spring arms 25 to be spread apart, which at first is countered only by the spring force of the two contact spring arms 25. During further insertion of the tab contact between the contact spring arms 25, the contact spring arms 25 finally come to abut the free ends of the outer back-up spring arms 45. Upon still further insertion, not only the contact spring arms 25 but also the outer back-up spring arms 45 are spread apart. During this last phase of the insertion operation, the sum of the spring forces of the contact spring arms 25 and of the outer back-up spring arms 45 counteracts such spreading apart. Starting with this moment of time, a contact force corresponding to the sum of these two spring forces is produced between the receptacle contact 11 and the tab contact.

The width of the spacing lugs 53 in spreading direction of the outer back-up spring arms 45 is selected such that the spreading gap between the two contact spring arms 25 in contact line 31 is slightly smaller than the thickness of the tab contact. The effect achieved by such dimensioning is that, during the largest part of the insertion operation, only the relatively low spring force of the contact spring arms 25 becomes effective, and the sum of the spring forces of the contact spring arms 25 and of the outer back-up spring arms 45 becomes effective only in the end phase of the insertion operation.

Projecting from the mating-side ends of the sidewalls 43 of the outer back-up spring body 39 are extended portions 59 bent into the mating-side end of the outer back-up spring body 39 with such convergence of the free ends thereof towards each other that an auxiliary funnel 61 is formed. Auxiliary funnel 61 facilitates insertion of the tab contact into the insertion funnel 33 of the contact spring arms 25.

Figure 8:
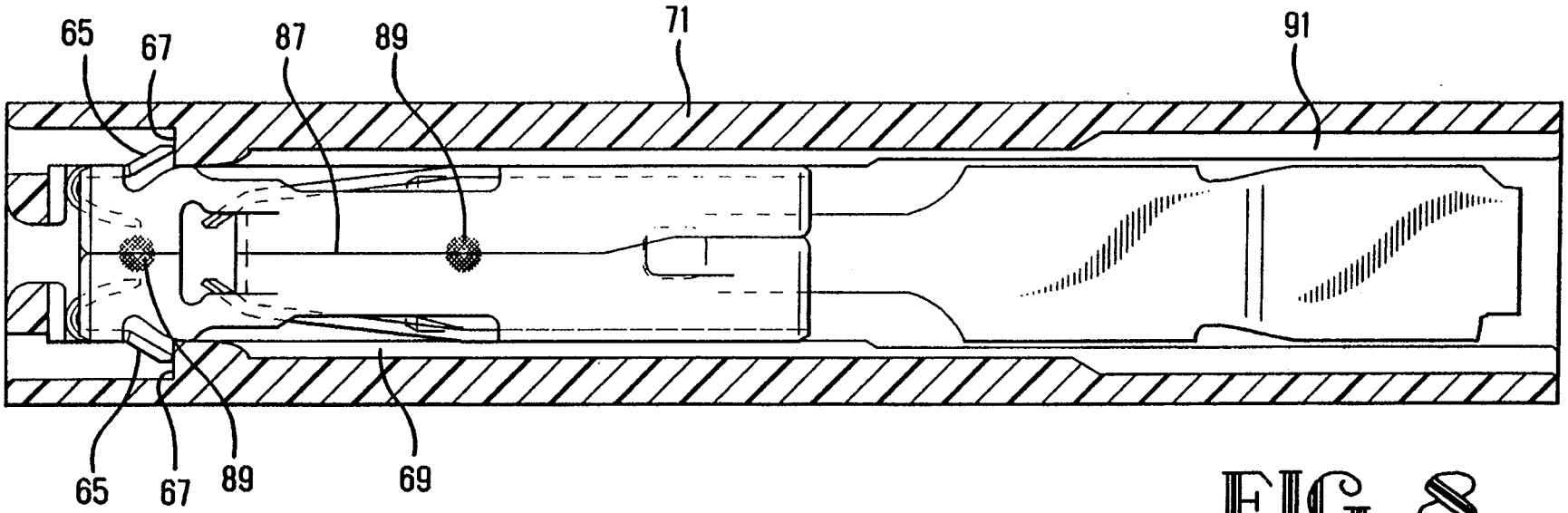
FIG. 8 shows a sectional view of an insulating housing having receiving chambers, illustrating one such chamber having a contact according to the invention inserted therein.

Extending from the mating-side ends of the cut-free openings 63, produced in conjunction with the cutting-free of the outer back-up spring arms 45, are locking lances 65 which project obliquely outwardly and have their free ends directed towards the wire terminating portion 15. These lances cooperate with locking shoulders 67 formed at corresponding locations of associated contact receiving chambers 69 in a connector housing 71 of insulating material, as shown in FIG. 8.

The locking lances 65 preferably are of short length, preferably in the range from about 10 to 20 percent of the length of the contact spring arms 25.

Locking lances for locking electrical contacts in the contact receiving chambers of connector housings are usually provided in the region of the contact body 21, i.e. in the vicinity of the wire terminating portion 15 and thus approximately in the longitudinal center of the contact as a whole, or even at the wire-terminating-side longitudinal end of the contact. The electrical wires extending from the wire terminating portions of contacts of a connector are often subjected to transverse forces during operation. These forces result in that a contact concerned performs pivotal motions transversely of its longitudinal direction, with the pixot axis of this pivotal motion being located in the region of the locking lances. When the locking lances are disposed in conventional manner in the longitudinal center or even at the wire-terminating-side end of the contact, such transverse forces acting on the terminated wire lead to a correspondingly high pivotal motion of the longitudinal end of the contact on the mating side. These strong pivotal motions cause an undesired mechanical load of the connection between receptacle contact and tab contact.

This problem is overcome by the arrangement of the locking lances 65 on the mating-side end of the outer back-up spring body 39 according to the invention. Due to the fact that the rotational axis for pivotal motions as a result of transverse forces applied to a crimpingly terminated wire is now located at the mating-side end of the outer back-up spring body 39 and thus of contact 11, the contact portion between contact spring arms 25 and the tab inserted therebetween remains substantially unaffected by such pivotal motions. The mechanical loads mentioned are thus largely avoided. Furthermore, it is possible to allow more tolerance play between the contact spring arms 25 and the tab inserted therebetween. Due to the fact that the contact portion between the contact spring arms 25 and the tab inserted therebetween must be designed for transmitting a specific current intensity that is dependent on the particular application, the contact spring arms 25 and the tab must overlap each other by a minimum width in all instances of movement for being able to tranfer this current intensity across the contact location. Since, when the locking lances are positioned according to the invention, only a slight pivotal motion can occur when transverse forces act on the terminated wire, the risk is low that the contact-establishing overlapping portion between the contact spring arms 25 and the tab changes significantly due to the pivotal forces acting on the wire terminating portion 15. This allows more tolerance play between the contact spring arms 25 and the tab than in case of stronger pivotal motions as they may occur when the locking lances are positioned in the center or even at the wire terminating end of the contact.

As is clearly gatherable from FIGS. 1 to 3, the longitudinal edges 73 both of top part 51 and of bottom part 57 of the outer back-up spring body 39 are each provided with an outwardly directed covex bulge 75 in the region of their mating-side ends. The convex bulges are of such a shape that the distance between their outer contour and the respectively adjacent locking lance 65, as seen when projecting this locking lance 65 into the plane of the top part 51 or bottom part 57, respectively, provided with the bulge concerned, is smaller than the thickness of the thinnest wire to be terminated to contact 11 or another contact of the same connector housing. This prevents tangling of wires in the locking lances 65. This is a serious problem with contacts having conventional locking lances which often are not only considerably longer than the present locking lances 65 but are not provided, either, with a tangling projection for wires in the form of the bulge 75. Such tangling occurs often and is a nuisance in making and handling cable harnesses the lines of which are terminated to contacts like the contact concerned herein, especially when the production of such harnesses and the termination of contacts to the wires thereof is made by means of automatic machines.

The bulges 75 have a further function. They render possible exact guiding of the contact 11 provided with the outer back-up spring 13 in the contact receiving chamber 69. The bulges 75 can be defined very well in the stamping operation as regards their dimensions. The contact 11 provided with the outer back-up spring 13 thus can be positioned very well within the contact receiving chamber 69.

The bulges 75 result in that the contact 11 provided with the outer back-up spring 13 is supported in the contact zone of contact 11. In case of a tumbling motion of the contact 11 provided with the outer back-up spring 13 in the contact receiving chamber 69, e.g. because of transverse forces acting on the wire terminated thereto, the contact zone thus remains at rest. Other portions of the contact 11, in particular the wire terminating portion 15, are free to tumble. Therefore, a space 91 can be left free in the contact receiving chamber 69 outside of the portions cooperating with the bulges 75. This facilitates introduction of the contact 11 provided with the outer back-up spring 13.

The outer back-up spring 13 is adapted to be snapped onto contact 11. To this end, a resilient (supple) locking lance 77 and 79 is provided both in the top part 51 and in the bottom part 57, respectively, and a locking stop 81 is provided in top part 51 of the outer back-up spring body 39. The locking lances 77, 79 and the locking stop 81 are each struck out from the top part 51 and the bottom part 57, respectively, and are bent into the interior of the outer back-up spring body 39. While locking stop 81 extends vertically into the interior of outer back-up spring body 39, locking lances 77 and 79 project obliquely into the interior of outer back-up spring body 39, with the free ends of the locking lances 77, 79 being directed towards the mating-side end of the outer back-up spring body 39.

In the embodiment shown in FIG. 1, the locking lances 77, 79 are cut free from the top part 51 and the bottom part 57, respectively, and then are bent into the box portion 41 of the outer back-up spring body 39. FIGS. 2 to 5 show an embodiment that is modified with respect to the locking lances 77, 79. In this embodiment, the locking lances 77 and 79 are each formed in that a corresponding portion of the top part 51 and the bottom part 57, respectively, has been sheared through and pushed inwardly into the interor of the box portion 41.

The locking stop 81 can be formed in the same manner.

A further possibility consists in forming the locking projections by pushing the corresponding portion of the outer back-up spring inwardly in non-shearing manner, i.e. by forming a recess by inwardly directed pressure.

The resiling effect desired for the locking projections 77 and 79 is rendered possible in this embodiment by the resilience of the part of the outer back-up spring surrounding the respective locking projection.

When the outer back-up spring body 39 is snapped onto contact 11, the locking stop 81 is located opposite a transverse edge at the mating-side end of contact body 21, said transverse edge being constituted by the longitudinal end 23 on the mating side. The free ends of the locking lances 77 and 79 are each located opposite a transverse edge 82 on the wire terminating side, with the latter edge being formed by a cutout in the wire-terminating-side end of the top part 37 and the bottom part 83 of the contact body 21, respectively.

The wire-terminating-side transverse edges 82 cooperating with the free ends of the locking lances 77 and 79 may also be constituted by the wire-terminating-side ends of the top part 37 and the bottom part 83 of the contact body 21, respectively. The angle between the locking lances 77, 79 and the top part 51, respectively the bottom part 57, of the outer back-up spring body 39 is selected such that the free ends of the locking lances 77, 79, in the unstressed condition, are located at the level of the transverse edges 82 on the wire terminating side.

For mounting to contact 11, the outer back-up spring is slid onto the contact 11 from the mating-side free ends of the contact spring arms 25. When, in doing so, the locking lances 77 hit the mating-side longitudinal ends 23 of contact body 21, these lances evade in resilient manner and slide across top part 37 and bottom part 83 of contact body 21, until the free ends thereof have passed across the transverse edges 82 on the wire terminating side and the locking lances 77 and 79 are allowed to return into their unstressed position. In doing so, locking stop 81 cooperaates with the mating-side longitudinal end 23 of the top part 37 of the contact body 21 in such a manner that a further sliding motion of the outer back-up spring 13 in the direction towards wire terminating portion 15 is prevented. A backward sliding motion of the outer back-up spring 13 in the direction towards the mating-side end of the contact 11 is prevented by the cooperation between the locking lances 77, 79 and the transverse edges 82. The outer back-up spring 13 is in this position snapped onto contact body 21 and is locked there.

An operation such as moving locking lances disposed on the outer back-up spring into associated locking recesses on the contact, or bending of locking lances of the outer back-up spring about web portions of the contact is not necessary any more with the design of contact and outer back-up spring according to the invention. All operations on contact 11 and outer back-up spring 13, which serve for the locking process, can thus be carried out while contact 11 and outer back-up spring 13 are still separated from each other, preferably even on the flat stamped blanks before these are bent into the shape of contact 11 and outer back-up spring 13, respectively.

Figure 4:
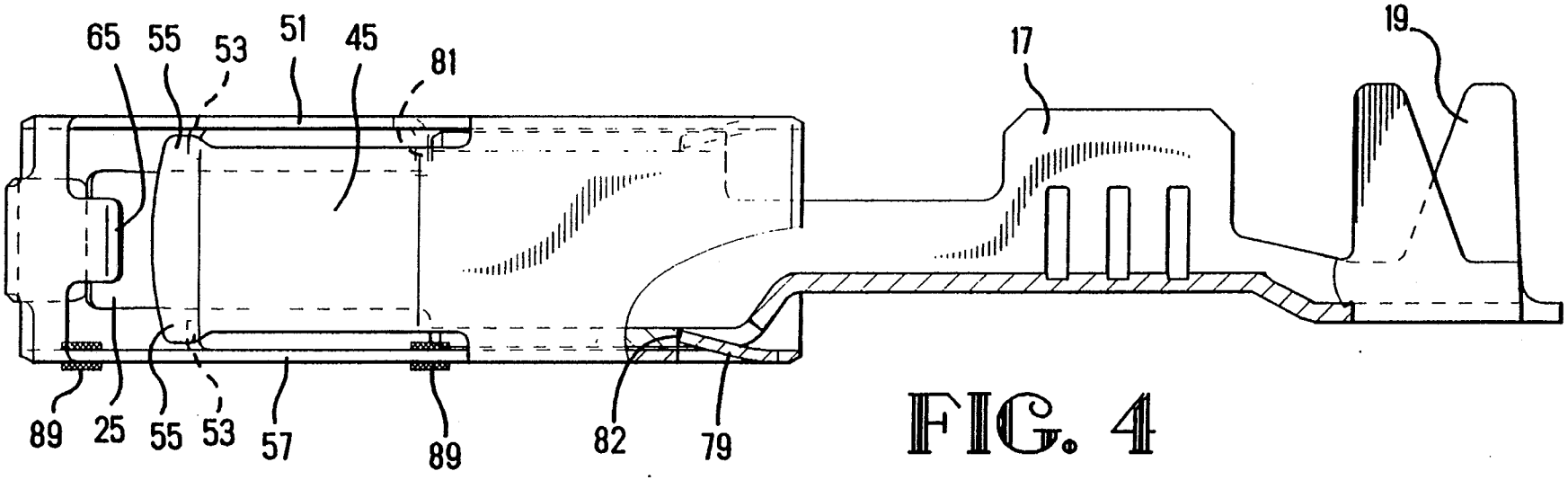
FIG. 4 shows a longitudinal side view of this contact.
Figure 5:
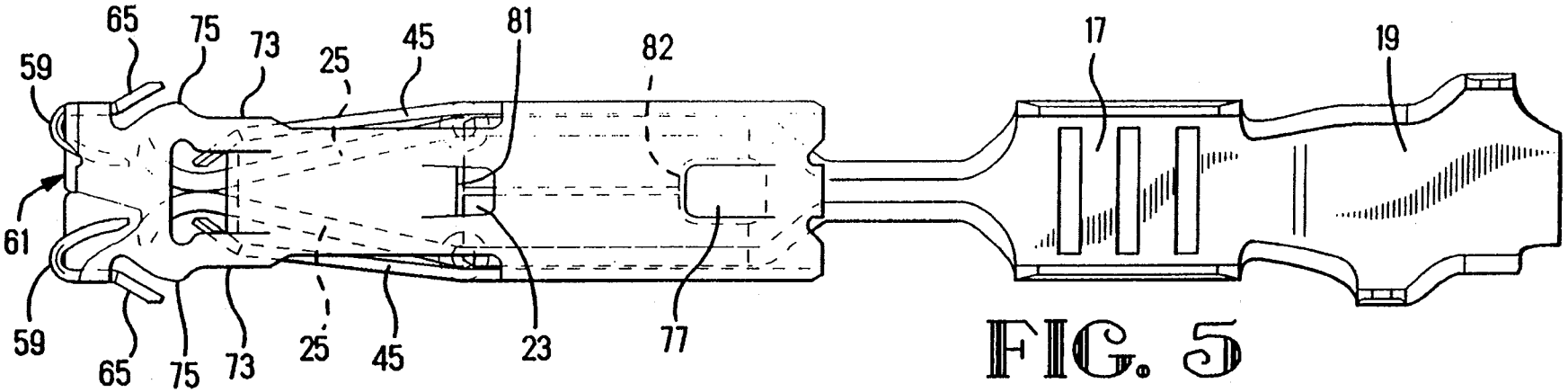
FIG. 5 shows a top plan view of said contact.

The outer back-up spring 13 has been created by bending a stamped sheet metal part in the form of a box. An abutment joint 87 formed during such bending is closed by welding. Preferably, a laser spot welding process is used therefor. Two welding spots 89 are shown in FIGS. 2 and 4.

By the configuration of the outer back-up spring body 39 according to the invention such that it encloses the contact spring arms 25 across the entire length thereof, good protection of the contact spring arms 25 against damage thereof is provided at the same time.

The rounded corners and edges, for instance in the root portion of auxiliary funnel 61, render possible easy insertion of the contact 11 provided with outer back-up spring 13 into a contact receiving chamber 69 connector housing 71.

Due to the fact that the wire-terminating-side end of the outer back-up spring body 39 projects at the four longitudinal sides thereof beyond the contact body 21, there is the possibility that secondary locking means, formed on or in connector housing 71 and engaging only in the closed condition behind an edge or a shoulder of the contact or the outer back-up spring, can engage in arbitrary manner on the wire-terminating-side end of each of the four longitudinal sides of the outer back-up spring body 39.

Figure 6:
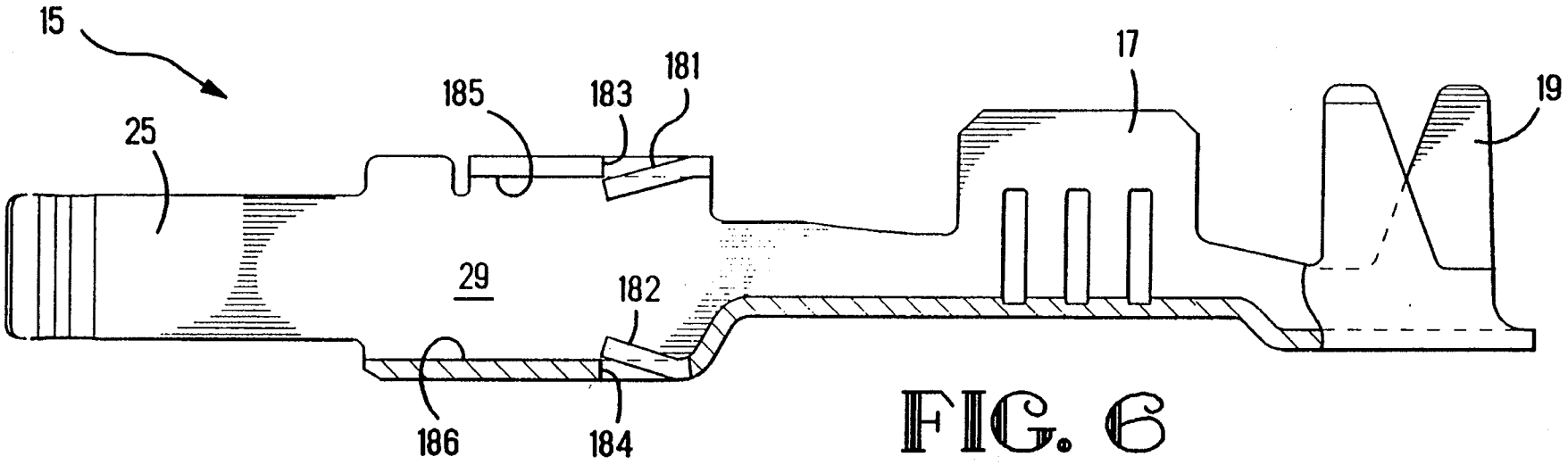
FIG. 6 shows a longitudinal cross-section through the inner spring contact.
Figure 7:
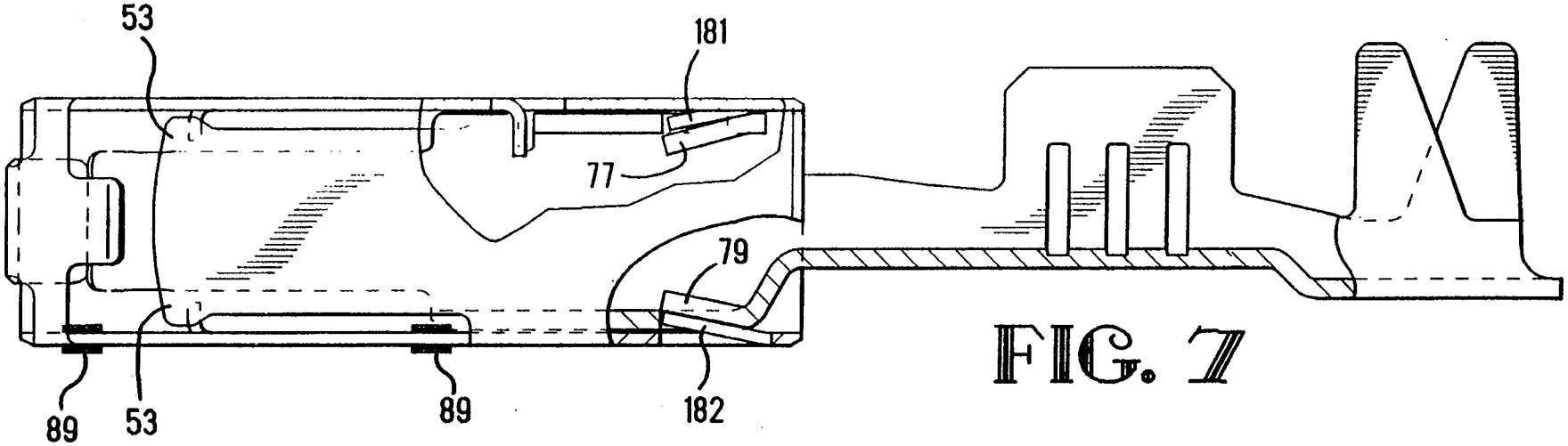
FIG. 7 shows a side view of the assembled contact of FIG. 6.

In another embodiment of the invention shown, with reference to FIGS. 6 and 7, the inner contact spring part 21 has upper and lower tab portions 181, 182, respectively, each of which project in the same direction as corresponding locking lances 77,79. It should be appreciated that the tabs 181, 182 form stop edges 183, 184 for engagement against the free end of the tabs 77, 79. The tabs 181, 182 are formed such that they are adjacent to the inner surface 185, 186. Thus when the outer back-up spring 18 is snapped over the inner contact spring, the locking lances 77, 79 are snapped into place within the opening formed by the tabs 181, 182, and engage edges 183, 184 as shown best in FIG. 5. The tabs 181, 182 prevent the tabs 77, 79 from slipping into the interior of the inner contact body, thereby allowing longitudinal movement of the back-up spring relative to the inner contact part.

I claim:

1. An electrical contact adapted for plugging connection, comprising at least one pair of contact spring arms for pluggably receiving a tab contact, the contact having arranged on its outside an outer back-up spring including at least one pair of outer back-up spring arms cooperating with the contact spring arms, characterized in that the outer back-up spring can be slid onto the outside of the contact from a mating-side end of the contact spring arms and is adapted to be snapped onto said contact, said contact further comprising a contact body having a longitudinal end on a mating side and a longitudinal end on a wire terminating side, a wire terminating portion extending from the wire terminating side longitudinal end thereof, the spring arms extending from the mating side longitudinal end thereof;

the contact body being provided on the mating side longitudinal end with at least one mating side transverse edge extending transversely of the mating direction, said contact body further including one wire terminating side transverse edge extending transversely of the mating direction;

said outer back-up spring having, in the portions of the outer back-up spring which are located adjacent the transverse edges of the contact body after said outer back-up spring has been slid onto the contact, at least one mating side locking projection and at least one wire terminating side locking projection, respectively, which project inwardly so as to reach the mating side transverse edge and the wire terminating side transverse edge of the contact body, respectively;

and wherein the wire terminating side locking projection is provided with a resiliently deflectable ramp slope such that, upon sliding of the outer back-up spring onto the contact, it can slide beyond the sidewall of the contact body belonging to the transverse edges and, when reaching the transverse edge on the wire terminating side, the locking projection can resile into a locking position cooperating with the wire terminating side transverse edge so that the locking projection on the mating side forms a stop for the transverse edge on the mating side, and wherein the contact has at least one tab extending inwardly therefrom to form the locking edge, the back-up spring including a complimentary tab abutting the locking edge, the back-up spring tab, when in the locked position, being substantially parallel to the contact tab.

2. An electrical contact adapted for plugging connection, comprising at least one pair of contact spring arms for pluggably receiving a tab contact, the contact having arranged on its outside an outer back-up spring including at least one pair of outer back-up spring arms cooperating with the contact spring arms, characterized in that the outer back-up spring can be slid onto the outside of the contact from a mating-side end of the contact spring arms and is adapted to be snapped onto said contact, said contact further comprising a contact body having a longitudinal end on a mating side and a longitudinal end on a wire terminating side, a wire terminating portion extending from the wire terminating side longitudinal end thereof, the spring arms extending from the mating side longitudinal end thereof;

the contact body being provided on the mating side longitudinal end with at least one mating side transverse edge extending transversely of the mating direction, said contact body further including one wire terminating side transverse edge extending transversely of the mating direction;

said outer back-up spring having, in the portions of the outer back-up spring which are located adjacent the transverse edges of the contact body after said outer back-up spring has been slid onto the contact, at least one mating side locking projection and at least one wire terminating side locking projection, respectively, which project inwardly so as to reach the mating side transverse edge and the wire terminating side transverse edge of the contact body, respectively;

and wherein the wire terminating side locking projection is provided with a resiliently deflectable ramp slope such that, upon sliding of the outer back-up spring onto the contact, it can slide beyond the sidewall of the contact body belonging to the transverse edges and, when reaching the transverse edge on the wire terminating side, the locking projection can resile into a locking position cooperating with the wire terminating side transverse edge so that the locking projection on the mating side forms a stop for the transverse edge on the mating side, and wherein the contact has at least one inwardly directed tab thereby forming a locking edge, a complimentary tab formed on said back-up spring, the back-up spring tab, when in the locked position, being disposed substantially parallel to and against the contact tab.

3. An electrical contact comprising at least one pair of contact spring arms for pluggably receiving a complementary contact, the contact having arranged on its outside an outer back-up spring including at least one pair of outer back-up spring arms, the outer back-up spring comprising an inwardly projecting locking lance shaped as a supple resilient beam, whereby the outer back-up spring can be slid over the outside of the contact from a mating-side end of the contact spring arm with substantially no outward deflection of a wall of the outer back-up spring carrying the locking lance, such that the locking lance is resiliently deformed and thereby outwardly deflected over the contact until the locking lance snaps resiliently inwards behind a wire terminating side transverse edge of the contact for preventing removal of the outer back-up spring from the contact.

4. An electrical contact according to claim 3 whereby the locking lance is shaped as a cantilever beam.

5. An electrical contact according to claim 4 whereby a free end of the locking lance is facing the mating side end of the contact.

6. An electrical contact according to claim 3 whereby the beam shape of the locking lance extends substantially in the direction of mating of the pluggable contacts.

7. An electrical contact according to claim 3 comprising a contact body extending between a mating side end and a wire terminating side end, a wire terminating portion extending from the wire terminating side end thereof and the contact spring arms extending from the mating side end thereof, the contact body comprising a mating side edge and the wire terminating side edge facing towards the mating side end and wire terminating side end respectively, and transverse to the mating direction, whereby after the outer back-up spring has been slid over the contact, at least one mating side locking projection of the back-up spring abuts the mating side edge whilst the locking lance abuts the wire terminating side transverse edge.

8. A contact according to claim 7 whereby the contact body has an inner tab struck obliquely inwardly from a sidewall thereof to form the wire terminating side transverse edge, the locking lance lying substantially against the inner tab when abutting the transverse edge.

9. A contact according to claim 8 whereby the locking lance is substantially parallel to the inner tab when lying thereagainst.

10. A contact according to claim 7 whereby the mating side locking projection is bent substantially orthogonaly inwards from a sidewall of the outer back-up spring.

11. A contact according to claim 7 whereby at least one said wire terminating side transverse edge is provided on each of two opposing sidewalls of the contact body, and the outer back-up spring comprises at least one said locking lance on each of two opposing sidewalls thereof.

12. A contact according to claim 3 whereby the outer back-up spring is bent from a flat sheet metal stamped part and has an abutment joint which is held together by welding preferably laser spot welding.

* * * * *